US006916402B2

(12) United States Patent
Shannon et al.

(10) Patent No.: US 6,916,402 B2
(45) Date of Patent: Jul. 12, 2005

(54) PROCESS FOR BONDING CHEMICAL ADDITIVES ON TO SUBSTRATES CONTAINING CELLULOSIC MATERIALS AND PRODUCTS THEREOF

(75) Inventors: Thomas G. Shannon, Neenah, WI (US); Gil Bernard Didier Garnier, Neenah, WI (US); Alberto Ricardo Negri, Appleton, WI (US); Mike T. Goulet, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 222 days.

(21) Appl. No.: 10/328,705

(22) Filed: Dec. 23, 2002

(65) Prior Publication Data

US 2004/0118533 A1 Jun. 24, 2004

(51) Int. Cl.[7] ..... D21H 11/20

(52) U.S. Cl. ..... 162/9; 162/109; 162/111; 162/112; 162/146; 162/157.6; 162/158; 162/164.1; 162/164.3; 162/164.4; 8/116.1; 8/181; 8/188; 8/194; 8/196; 8/116.4; 428/153; 428/154; 428/391; 428/393; 428/533; 428/534; 428/537.5; 536/56

(58) Field of Search ..... 162/9, 109, 111, 162/146, 157.6, 164.1, 182, 112, 164.3, 158, 164.4; 8/116.1, 116.4, 181, 188, 194, 196; 428/153, 154, 391, 393, 533, 534, 537.5; 536/56

(56) References Cited

U.S. PATENT DOCUMENTS

| | | | |
|---|---|---|---|
| 1,812,832 | A | 6/1931 | Rafton |
| 3,056,714 | A | 10/1962 | Feigley, Jr. et al. |
| 3,128,311 | A | 4/1964 | Shirley et al. |
| 3,152,998 | A | 10/1964 | Moss |
| 3,155,728 | A | 11/1964 | Lesene |
| 3,236,895 | A | 2/1966 | Lee et al. |
| 3,322,725 | A | 5/1967 | Hunter et al. |
| 3,347,926 | A | 10/1967 | Zech |
| 3,436,359 | A | 4/1969 | Hubin et al. |
| 3,556,932 | A | 1/1971 | Coscia et al. |
| 3,654,370 | A | 4/1972 | Yeakey |
| 3,671,502 | A | 6/1972 | Samour et al. |
| 3,677,886 | A | 7/1972 | Forssblad et al. |
| 3,700,623 | A | 10/1972 | Keim |
| 3,770,575 | A | 11/1973 | Ball |
| 3,772,076 | A | 11/1973 | Keim |
| 3,779,912 | A | 12/1973 | Redmore et al. |
| 3,855,158 | A | 12/1974 | Petrovich et al. |
| 3,899,388 | A | 8/1975 | Petrovich et al. |
| 3,994,771 | A | 11/1976 | Morgan, Jr. et al. |
| 4,013,514 | A | 3/1977 | Wildi et al. |
| 4,014,736 | A | 3/1977 | Sexton |
| 4,014,933 | A | 3/1977 | Boettger et al. |
| 4,049,493 | A | 9/1977 | Lare |
| 4,081,319 | A | 3/1978 | Conway |
| 4,093,506 | A | 6/1978 | Richter |
| 4,129,528 | A | 12/1978 | Petrovich et al. |
| 4,129,722 | A | 12/1978 | Iovine et al. |
| 4,144,122 | A | 3/1979 | Emanuelsson et al. |
| 4,147,586 | A | 4/1979 | Petrovich et al. |
| 4,153,581 | A | 5/1979 | Habermann |
| 4,210,489 | A | 7/1980 | Markofsky |
| 4,222,921 | A | 9/1980 | Van Eenam |
| 4,251,410 | A | 2/1981 | Danner et al. |
| 4,310,384 | A | 1/1982 | Meredith et al. |
| 4,383,834 | A | 5/1983 | Degen et al. |
| 4,423,194 | A | 12/1983 | Löbach et al. |
| 4,440,597 | A | 4/1984 | Wells et al. |
| 4,448,638 | A | 5/1984 | Klowak |
| 4,481,076 | A | 11/1984 | Herrick |
| 4,481,077 | A | 11/1984 | Herrick |
| 4,482,429 | A | 11/1984 | Klowak |
| 4,508,594 | A | 4/1985 | Jansma et al. |
| 4,514,345 | A | 4/1985 | Johnson et al. |
| 4,521,490 | A | 6/1985 | Pocius et al. |

(Continued)

FOREIGN PATENT DOCUMENTS

| | | | |
|---|---|---|---|
| CA | 2296826 | A1 | 7/2000 |
| CA | 2296891 | A1 | 7/2000 |
| EP | 0109282 | B1 | 5/1984 |
| EP | 0226408 | B1 | 6/1987 |
| EP | 0613979 | A1 | 9/1994 |
| EP | 0643164 | B1 | 3/1995 |
| EP | 0685593 | A2 | 12/1995 |
| EP | 0685593 | A3 | 12/1995 |
| EP | 0851062 | A2 | 7/1998 |
| WO | WO 8902952 | A1 | 4/1989 |

(Continued)

OTHER PUBLICATIONS

TAPPI Official Test Method T 402 om–93, "Standard Conditioning and Testing Atmospheres For Paper, Board, Pulp Handsheets, and Related Products," published by the TAPPI Press, Atlanta, Georgia, revised 1993, pp. 1–3.

(Continued)

*Primary Examiner*—Peter Chin
(74) *Attorney, Agent, or Firm*—Dority & Manning, P.A.

(57) ABSTRACT

Articles containing cellulose materials and treated with a chemical additive are disclosed. In accordance with the present invention, at least a portion of the cellulose containing the article is modified to include a first moiety. A chemical additive, such as softener or a humectant, is then chosen that includes a second moiety. When the chemical additive is applied to the article, the second moiety on the chemical additive forms a chemical linkage with the first moiety on the cellulose material. In this manner, the chemical additive becomes bonded to the cellulose material alleviating problems associated with retention. In one embodiment, the present invention is directed to the formation of tissue products, such as facial tissue, bath tissue and paper towels.

76 Claims, No Drawings

U.S. PATENT DOCUMENTS

| | | | |
|---|---|---|---|
| 4,528,239 | A | 7/1985 | Trokhan |
| 4,529,480 | A | 7/1985 | Trokhan |
| 4,618,448 | A | 10/1986 | Cha et al. |
| 4,764,418 | A | 8/1988 | Kuenn et al. |
| 4,766,245 | A | 8/1988 | Larkin et al. |
| 4,808,266 | A | 2/1989 | Faurie |
| 4,824,689 | A | 4/1989 | Kuenn et al. |
| 4,908,101 | A | 3/1990 | Frisk et al. |
| 4,921,902 | A | 5/1990 | Evani et al. |
| 4,929,670 | A | 5/1990 | Billmers et al. |
| 4,959,125 | A | 9/1990 | Spendel |
| 4,969,976 | A | 11/1990 | Reed |
| 4,986,882 | A | 1/1991 | Mackey et al. |
| 5,011,918 | A | 4/1991 | Bilimers et al. |
| 5,035,772 | A | 7/1991 | Agnemo et al. |
| 5,049,634 | A | 9/1991 | Tsai et al. |
| 5,073,234 | A | 12/1991 | Mollett et al. |
| 5,087,324 | A | 2/1992 | Awofeso et al. |
| 5,098,522 | A | 3/1992 | Smurkoski et al. |
| 5,100,956 | A | 3/1992 | O'Lenick, Jr. |
| 5,127,994 | A | 7/1992 | Johansson |
| 5,137,600 | A | 8/1992 | Barnes et al. |
| 5,139,671 | A | 8/1992 | Henricson et al. |
| 5,143,999 | A | 9/1992 | Setiabudi et al. |
| 5,177,165 | A | 1/1993 | Valint, Jr. et al. |
| 5,187,219 | A | 2/1993 | Furman, Jr. |
| 5,221,434 | A | 6/1993 | Henricson |
| 5,230,776 | A | 7/1993 | Andersson et al. |
| 5,238,501 | A | 8/1993 | Kappel et al. |
| 5,260,171 | A | 11/1993 | Smurkoski et al. |
| 5,275,700 | A | 1/1994 | Trokhan |
| 5,300,192 | A | 4/1994 | Hansen et al. |
| 5,328,565 | A | 7/1994 | Rasch et al. |
| 5,334,289 | A | 8/1994 | Trokhan et al. |
| 5,348,620 | A | 9/1994 | Hermans et al. |
| 5,353,521 | A | 10/1994 | Orloff |
| 5,362,415 | A | 11/1994 | Egraz et al. |
| 5,397,435 | A | 3/1995 | Ostendorf et al. |
| 5,397,834 | A | 3/1995 | Jane et al. |
| 5,405,501 | A | 4/1995 | Phan et al. |
| 5,431,786 | A | 7/1995 | Rasch et al. |
| 5,435,919 | A | 7/1995 | Ladika et al. |
| 5,437,766 | A | 8/1995 | Van Phan et al. |
| 5,494,554 | A | 2/1996 | Edwards et al. |
| 5,496,624 | A | 3/1996 | Stelljes, Jr. et al. |
| 5,500,277 | A | 3/1996 | Trokhan et al. |
| 5,501,768 | A | 3/1996 | Hermans et al. |
| 5,514,523 | A | 5/1996 | Trokhan et al. |
| 5,529,665 | A | 6/1996 | Kaun |
| 5,547,745 | A | 8/1996 | Hansen et al. |
| 5,552,020 | A | 9/1996 | Smith et al. |
| 5,554,467 | A | 9/1996 | Trokhan et al. |
| 5,566,724 | A | 10/1996 | Trokhan et al. |
| 5,575,891 | A | 11/1996 | Trokhan et al. |
| 5,585,456 | A | 12/1996 | Dulany et al. |
| 5,591,306 | A | 1/1997 | Kaun |
| 5,598,642 | A | 2/1997 | Orloff et al. |
| 5,603,804 | A | 2/1997 | Hansen et al. |
| 5,607,551 | A | 3/1997 | Farrington, Jr. et al. |
| 5,609,727 | A | 3/1997 | Hansen et al. |
| 5,612,409 | A | 3/1997 | Chrobaczek et al. |
| 5,618,483 | A | 4/1997 | Weigel et al. |
| 5,624,532 | A | 4/1997 | Trokhan et al. |
| 5,624,790 | A | 4/1997 | Trokhan et al. |
| 5,628,876 | A | 5/1997 | Ayers et al. |
| 5,633,300 | A | 5/1997 | Dasgupta |
| 5,637,194 | A | 6/1997 | Ampulski et al. |
| 5,656,132 | A | 8/1997 | Farrington, Jr. et al. |
| 5,667,636 | A | 9/1997 | Engel et al. |
| 5,672,248 | A | 9/1997 | Wendt et al. |
| 5,674,362 | A | 10/1997 | Underwood et al. |
| 5,695,607 | A | 12/1997 | Oriaran et al. |
| 5,698,688 | A | 12/1997 | Smith et al. |
| 5,723,022 | A | 3/1998 | Dauplaise et al. |
| 5,725,736 | A | 3/1998 | Schroeder et al. |
| 5,746,887 | A | 5/1998 | Wendt et al. |
| 5,772,845 | A | 6/1998 | Farrington, Jr. et al. |
| 5,783,041 | A | 7/1998 | Underwood |
| 5,785,813 | A | 7/1998 | Smith et al. |
| 5,788,815 | A | 8/1998 | Norell et al. |
| 5,807,944 | A | 9/1998 | Hirt et al. |
| 5,874,495 | A | 2/1999 | Robinson |
| 5,906,926 | A | 5/1999 | Keunecke et al. |
| 5,935,383 | A | 8/1999 | Sun et al. |
| 6,059,928 | A | 5/2000 | Van Luu et al. |
| 6,096,169 | A | 8/2000 | Hermans et al. |
| 6,103,063 | A | 8/2000 | Oriaran et al. |
| 6,137,600 | A | 10/2000 | Sakurai et al. |
| 6,143,135 | A | 11/2000 | Hada et al. |
| 6,224,714 | B1 | 5/2001 | Schroeder et al. |
| 6,228,126 | B1 | 5/2001 | Cimecioglu et al. |
| 6,235,155 | B1 | 5/2001 | Schroeder et al. |
| 6,235,602 | B1 | 5/2001 | Yuzuriha |
| 6,274,667 | B1 | 8/2001 | Shannon et al. |
| 6,287,418 | B1 | 9/2001 | Schroeder et al. |
| 6,361,651 | B1 | 3/2002 | Sun |
| 6,365,667 | B1 | 4/2002 | Shannon et al. |
| 6,368,456 | B1 | 4/2002 | Cimecioglu et al. |
| 6,379,494 | B1 | 4/2002 | Jewell et al. |
| 6,398,911 | B1 | 6/2002 | Schroeder et al. |
| 6,409,881 | B1 | 6/2002 | Jaschinski |
| 6,423,183 | B1 | 7/2002 | Goulet et al. |
| 6,465,602 | B2 | 10/2002 | Schroeder et al. |
| 6,472,487 | B2 | 10/2002 | Schroeder et al. |
| 6,517,678 | B1 | 2/2003 | Shannon et al. |
| 6,596,126 | B1 | 7/2003 | Shannon et al. |
| 6,620,295 | B2 | 9/2003 | Shannon et al. |
| 6,632,904 | B2 | 10/2003 | Schroeder et al. |
| 2002/0074098 | A1 | 6/2002 | Shannon et al. |
| 2002/0134521 | A1 | 9/2002 | Shannon et al. |
| 2002/0139500 | A1 | 10/2002 | Runge et al. |
| 2003/0037894 | A1 | 2/2003 | Shannon et al. |

FOREIGN PATENT DOCUMENTS

| | | | |
|---|---|---|---|
| WO | WO 9012146 | A1 | 10/1990 |
| WO | WO 9419534 | A1 | 9/1994 |
| WO | WO 9501479 | A1 | 1/1995 |
| WO | WO 9520066 | A1 | 7/1995 |
| WO | WO 9606223 | A1 | 2/1996 |
| WO | WO 9713026 | A1 | 4/1997 |
| WO | WO 9736052 | A2 | 10/1997 |
| WO | WO 9736052 | A3 | 10/1997 |
| WO | WO 9809021 | A1 | 3/1998 |
| WO | WO 9816570 | A1 | 4/1998 |
| WO | WO 9817864 | A1 | 4/1998 |
| WO | WO 9823814 | A1 | 6/1998 |
| WO | WO 9835095 | A1 | 8/1998 |
| WO | WO 9934057 | A1 | 7/1999 |
| WO | WO 0039389 | A1 | 7/2000 |
| WO | WO 0148025 | A1 | 7/2001 |
| WO | WO 0231260 | A3 | 4/2002 |
| WO | WO 0231260 | A2 | 4/2002 |
| WO | WO 02072946 | A2 | 9/2002 |
| WO | WO 02072951 | A2 | 9/2002 |

OTHER PUBLICATIONS

Smook, Gary A., Editor, "Non–Fibrous Additives to Papermaking Stock," Chapter 15, Handbook for Pulp & Paper Technologists, Second Edition, Angus Wilde Publications, Bellingham, WA, 1992, pp. 220, 225–226.

U.S. Appl. No. 09/747,393, filed Dec. 22, 2000, Shannon et al., Process For Incorporating Poorly Substantive Paper Modifying Agents Into A Paper Sheet Via Wet End Addition.
Article—*Ether bond crosslinking of cellulose with epichlorohydrin*, Etherification of Cellulose, pp. 243–246.
Article—*Cellulose carbamate*, D. Klemm, B. Philipp, T. Heinze, U. Heinze, and W. Wagenknecht, Comprehensive Cellulose Chemistry vol. 2, Functionalization of Cellulose, 1998, pp. 161–162.
Chapter 17 entitled "Derivatives of Cellulose" from *Wood Chemistry Ultrastructure Reactions*, D. Fengel and G. Wegener, 1983, pp. 482–525.
Article—*Preparation of acid anhydrides*, Stanley H. Pine, James B. Hendrickson, Donald J. Cram, and George S. Hammond, Organic Chemistry, $4^{th}$ Edition, p. 312.
Article—*Comparative Spectroscopic Study of the Modification of Cellulosic Materials with Different Coupling Agent*, Journal of Applied Polymer Science, vol. 75, 2000, pp. 256–266.
Article—*Ultraviolet Spectroscopic Study Of The Cellulose Functinalization With Silances*, Spectroscopy Letters, vol. 32, No. 6, 1999, pp. 993–1003.
Article—*Copolymers of acrylamide and surfactant macromonomers: synthesis and solution properties*, D. N. Schulz, J. J. Kaladas, J. J. Maurer, J. Bock, S. J. Pace, and W. W. Schulz, Polymer, vol. 28, 1987, pp. 2110–2115.
Organic Synthesis, Collective vol. 4, *Ethanedithiol*, 1963, pp. 401–403.
Article—*The Standardization and Analysis of Hand Evaluation* ($2^{nd}$ *Edition*), Sueo Kawabata, The Textile Machinery Society of Japan, Jul. 1980, pp. 28–51.
Paper Chemistry, J. C. Roberts, 1996, Blackie Academic & Professional, Glasgow XP002210178, Chapter 7, Wet–Strength Chemistry, Point 7.3.4, Glyoxalated Polyacrylamide Resins, pp. 107–110.

PROCESS FOR BONDING CHEMICAL ADDITIVES ON TO SUBSTRATES CONTAINING CELLULOSIC MATERIALS AND PRODUCTS THEREOF

BACKGROUND OF THE INVENTION

In the manufacture of paper products, such as facial tissue, bath tissue, paper towels, dinner napkins and the like, a wide variety of product properties are imparted to the final product through the use of chemical additives. Examples of such chemical additives include softeners, humectants, debonders, wet strength agents, dry strength agents, sizing agents, opacifiers and the like. In many instances, more than one chemical additive is added to the product at some point in the manufacturing process.

Further, some chemical additives simply do not bond well with the cellulosic materials, such as cellulosic fibers. For instance, problems have been experienced in the past in bonding humectants and softeners to paper webs. Humectants have utility in tissue products for improving tactile feel through plasticization of fibers by increasing the humectancy of the finished web. Examples of humectants include, for instance, polyhydric alcohols such as propylene glycol, and polyethers such as poly (ethylene glycol), poly (propylene glycol) and their corresponding co-polymers. Since these materials are generally non-ionic and have no charge, there are poorly retained by cellulose fibers and typically cannot be added in the wet end of a paper making process.

Similarly, softeners such as polysiloxanes also fail to carry a charge necessary to form a strong ionic bond with cellulosic materials. Recently, in order to improve polysiloxane retention on paper webs and in order to improve the properties of the polysiloxanes, the polysiloxanes have been amino-functionalized. Still, retention of amino-modified polysiloxanes on cellulose fibers contained in an aqueous slurry, in some applications, is no better than about seventy percent (70%). Retention can also be dependent on aging (storage time) of the amino-polysiloxane as well.

A cellulose papermaking fiber primarily contains two types of functional groups, hydroxyl and carboxyl. At a typical papermaking pH of about 4 to about 9 a portion of the carboxyl groups are ionized causing the cellulose papermaking fibers to possess a net anionic charge. These anionic sites on the cellulose fibers serve as the source of attachment for wet end chemical additives. The amount of carboxyl groups on the cellulose fibers is limited and depends on the nature of the pulp. In general bleached kraft pulps contain about 2 to about 4 milli equivalents of carboxyl per 100 grams of pulp while mechanical pulps may contain upwards of about 30 to about 40 milli equivalents of carboxyl groups per 100 grams of pulp.

Most wet end chemical additives used in papermaking rely on electrostatic interaction for retention of the additive to the papermaking fibers. In general, the chemical additives will possess a positive charge somewhere on the molecule. The positive charge is attracted to the negative charge on the cellulose fibers and an electrostatic interaction retains the chemical additives on the cellulose fibers. Where anionic chemical additives are used, a cationic promoter will be used to bridge the anionic chemical additive and the anionic sites on the cellulose fibers. The limited number of carboxyl groups on the cellulose fiber limits the amount of chemical additives that can be retained on the cellulose fibers in addition to problems experienced with chemical additives that have weak anionic properties to begin with. Also, where more than one chemical additive is used in the wet end, competition between the two chemical additives for the limited number of bonding sites on the cellulose fibers can result in inconsistent retention leading to variable product performance.

When added in the wet end, non-ionic chemical additives as described above show poor retention to the cellulose papermaking fibers. An option to circumvent this issue is to covalently bond the molecule to the cellulose fibers in some way. A problem with covalent bonding to cellulose lies in the type of groups on the cellulose fibers that are available for reaction. The two chemically active groups on the cellulose fibers are hydroxyls and carboxyls. The carboxyl groups are generally too few in number and too low in reactivity to be useful. Also, any reaction at the carboxyl group will reduce the number of available ionic bonding sites on the cellulose fibers hence limiting the ability to retain any charged wet end chemical additives that may need to be used. The hydroxyl groups, while plentiful, are problematic in that anything that can react with a hydroxyl group can also react with water. In a typical papermaking process, on a molar basis, the amount of the hydroxyl groups on water available for reaction is magnitudes of order larger than the amount of the hydroxyl groups of the cellulose fibers available for reaction. Simple kinetics will therefore dictate a preference for reaction with water hydroxyl groups over the cellulose fiber hydroxyl groups. This problem can be overcome as exemplified with the sizing agents ASA (alkyl succinic anhydride) and AKD (alkyl ketene dimer). However, complicated and expensive emulsification must be performed in order to allow addition of these chemical additives to the wet-end of the process. The costs become prohibitively high for use in tissue. Additionally, such materials generally react with the hydroxyl groups of the cellulose fibers only after the forming process and removal of a majority of the water. Therefore the emulsions are cationic and the chemical additive is retained in the non-reacted state due to the attraction of the cationic emulsion for the anionic sites of the cellulose fibers. Hence, even in this case the amount of anionic sites on the cellulose fibers available for bonding with other charged wet end chemical additives is reduced.

Therefore, there is a need for a means of retaining higher and more consistent levels of paper modifying chemical additives on the paper web via wet end addition or topical application. Furthermore, there is a need for retaining more than one chemical functionality to a paper web that mitigates the limitations created by the limited number of bonding sites. There is also a need in the art for a method for bonding generally non-ionic additives to cellulosic materials and, in particular, a need exists for a method for bonding humectants and softeners onto cellulosic materials.

SUMMARY OF THE INVENTION

In general, the present invention is directed to a process for bonding chemical additives to cellulosic materials and to products made from the process. The chemical additive can be, for instance, a softener or a humectant. For example, in one embodiment, the softener comprises a polysiloxane. According to the present invention, a cellulosic material is modified to include particular functional moieties. By modifying the cellulose, the present inventors have discovered that the cellulose will then react with particular types of softeners and humectants.

Ultimately, a chemical linkage is formed between the chemical additive and the cellulosic material. For example, in one embodiment, the chemical linkage may be a covalent bond. Once reacted with the modified cellulose material, the chemical additive becomes substantive to the cellulose. Chemical additives can be applied in this manner to cellulosic fibers contained in an aqueous slurry. The chemical additive according to the present invention remains on the fibers during the production of a paper web.

In one embodiment, the present invention is directed to an article that includes a substrate containing cellulose. The cellulose contained in the substrate is modified so as to form a first moiety. The first moiety can generally be present at the surface of the cellulose.

In accordance with the present invention, a chemical additive comprising a softener or a humectant is contacted with the modified cellulose. A chemical additive is selected that contains a second moiety that forms a chemical linkage with the first moiety.

For instance, in one embodiment, when the first moiety comprises an aldehyde, an epoxy or an anhydride group, the second moiety comprises an amine, a thiol, an amide, a sulfonamide or a sulfinic acid group. In another embodiment, when the first moiety comprises an amine, a thiol, an amide, a sulfonamide or a sulfinic acid group, the second moiety comprises an aldehyde, a carboxylate, an epoxy, or an aldehyde group. In many applications, the first moiety reacts with the second moiety to form a covalent bond.

In one particular embodiment, for instance, the substrate can be a paper web containing cellulosic fibers. At least a portion of the cellulosic fibers can be modified to form, for instance, an aldehyde group. A softener or a humectant containing, for instance, an amine group, can then be reacted with the aldehyde group contained on the modified cellulose. Suitable softeners that may be used in this embodiment include amine modified polysiloxanes. Suitable humectants, on the other hand, include an amine functional polyether, an amine functional polyol or an amine functional polyhydroxy compound.

Various different articles can be formed in accordance with the present invention. Such articles can include, for instance, tissue products, such as facial tissues, bath tissues and paper towels. Alternatively, the article can be a personal care article. Personal care articles refer to diapers, feminine hygiene products, and the like.

Methods of making paper products that can benefit from the various aspects of this invention are well known to those skilled in the papermaking art. Exemplary patents include U.S. Pat. No. 5,785,813 issued Jul. 28, 1998 to Smith et al. entitled "Method of Treating a Papermaking Furnish For Making Soft Tissue"; U.S. Pat. No. 5,772,845 issued Jun. 30, 1998 to Farrington, Jr. et al. entitled "Soft Tissue"; U.S. Pat. No. 5,746,887 issued May 5, 1998 to Wendt et al. entitled "Method of Making Soft Tissue Products"; and, U.S. Pat. No. 5,591,306 issued Jan. 7, 1997 to Kaun entitled "Method For Making Soft Tissue Using Cationic Silicones", all of which are hereby incorporated by reference.

DETAILED DESCRIPTION

It is to be understood by one of ordinary skill in the art that the present discussion is a description of exemplary embodiments only, and is not intended as limiting the broader aspects of the present invention.

In general, the present invention is directed to improving the retention of various chemical additives on articles containing cellulosic materials. Chemical additives that can be used in the present invention include, for instance, humectants or softeners. According to the present invention, the chemical additive can be bound through a chemical linkage to any suitable cellulosic material, such as pulp fibers, regenerated fibers, films, and the like.

In accordance with the present invention, in order to make the cellulosic material chemically receptive to various chemical additives, the cellulose is modified. For instance, the cellulose may be modified through a surface modification process that forms chemical moieties on the surface of the cellulose. A chemical additive is then selected that contains a functional moiety that reacts with the moieties on the surface of the cellulose. Thus, a chemical linkage, such as a covalent bond, is formed between the chemical additive and the cellulose material. Because the chemical additive is chemically bonded to the cellulose material, retention of the chemical additive on the cellulose is dramatically improved. In fact, through the process of the present invention, chemical additives such as softeners and humectants can be added at the wet end of a papermaking process while the cellulose fibers are present in an aqueous suspension. A paper web can be formed from the aqueous suspension without loosing a significant amount of the chemical additive. It should be understood, however, that the process of the present invention is also well suited to applications where the chemical additive is applied topically to the article containing the modified cellulose.

The moiety that is formed on the surface of the cellulose can vary depending upon the particular application. In one embodiment, for instance, the cellulose can be modified to form a moiety that comprises an aldehyde group, an epoxy group, or an anhydride group. When the moiety contained on the cellulose is any of the above, a chemical additive can be chosen that contains a corresponding moiety that comprises a primary amine, a secondary amine, a thiol, an amide, a sulfonamide, or a sulfinic acid group. For example, the chemical additive can be an amine-modified softener or a humectant that contains amine moieties. The amount of the reactive moiety on the cellulose can vary widely but typically will be greater than 6 m-eq/100 grams of fiber, more specifically greater than about 9 m-eq/100 grams of fiber and still more specifically greater than about 12 m-eq/100 grams of fiber.

In another embodiment of the present invention, the above groups of moieties may be reversed between the cellulose and the chemical additive. For example, in this embodiment, the modified cellulose can contain a moiety that includes a primary amine, a secondary amine, a thiol, an amide, a sulfonamide, or a sulfinic acid group. The chemical additive, on the other hand, can contain a moiety that comprises an aldehyde, a carboxylate, an epoxy, or an anhydride group.

Once the cellulose is modified to contain a moiety as described above and contacted with a chemical additive containing a corresponding moiety, a chemical reaction occurs forming a chemical linkage between the cellulose and the chemical additive. For many applications, for instance, a covalent bond forms between the modified cellulose and the chemical additive. In other embodiments, however, other bonds may form including other physiochemical bonds, hydrogen bonds, and the like. The bonding mechanism, however, must be sufficiently strong so as the attachment of the chemical additive to the fibers survives dilution forces and shear forces present in the processes used to manufacture the articles comprising the modified cellulose and chemical additive.

In order to describe the invention in more detail, first, modified cellulose materials that may be used in the present invention will be discussed including methods for modifying the cellulose. Next, various chemical additives that may be used in the present invention will be described. Such additives can include softeners and humectants. Finally, different embodiments of processes that may be used to contact the modified cellulose with the chemical additive will be described.

Modified Cellulose

In general, any suitable modified cellulose may be used in the present invention as long as the cellulose contains a moiety capable of reacting with an opposing moiety or functional group on a chemical additive. Moieties contained on the modified cellulose can include, for instance, aldehyde groups, epoxy groups, anhydride groups, amine groups, thiol groups, amide groups, sulfonamide groups, and sulfinic acid groups depending upon the particular chemical additive that is to be applied to the cellulosic material. Further, the cellulose can be modified according to various different processes. For example, the cellulose can be modified by chemical, physical or biological means.

In one embodiment, for instance, the cellulose material is modified to form aldehyde groups on the surface of the cellulose. Modified cellulose containing aldehyde groups on the surface of the cellulose are known. In particular, various methods and processes are available and known for forming aldehyde groups on cellulose. For example, cellulose can be modified to form aldehyde groups by oxidizing cellulose. The oxidation of cellulose can occur through chemical treatment, physical irradiation, or through enzyme treatment.

When modifying cellulose using chemical treatment according to an oxidation process, the cellulose is contacted with an oxidizing agent. Suitable oxidizing agents include, for example, ozone, peracids, such as periodate, dinitrogen tetroxide, dimethol sulfoxide/acetic an hydride, gaseous oxygen, hypochlorite, hypobromite, chromic acid and chromates, hypochlorous acid, hypobromous acid, hypoiodous acid, peroxides such as hydrogen peroxide, persulfates, perborates, perphosphates, oxidizing metal compounds, nitroxy compounds, 2,2,6,6,-tetramethylpiperidinyloxy free radicals (TEMPO oxidizing systems), suitable combinations thereof, and the like.

Processes for oxidizing cellulose using chemical treatment to form aldehyde groups are disclosed in, for instance, U.S. Pat. No. 6,409,881 to Jaschinski and in U.S. Pat. Nos. 6,228,126 and 6,368,456 both to Cimeciogou, et al., which are all incorporated herein by reference to the extent they are not contradictory to the present invention.

For example, Cimeciogou, et al. discloses a process for modifying cellulose pulp to produce aldehyde groups. For instance, the modified cellulose may have from about one to about 20 mmoles of aldehyde per 100 grams of cellulose. In Cimeciogou, et al., cellulose is oxidized in an aqueous solution with an oxidant having an equivalent oxidizing power of up to 5.0 grams of active chlorine per 100 grams of cellulose and an effective mediating amount of a nitroxyl radical.

It should be understood, however, that any suitable process for forming aldehyde groups on cellulose may be used in the present invention without being limited to any of the teachings of the above patents.

In addition to chemical treatment, cellulose materials can be oxidized to form aldehyde groups through exposure to radiant energy. For example, a plasma treatment on cellulose or a corona treatment on cellulose also oxidizes cellulose to form aldehyde groups.

In another embodiment, cellulose can be oxidized to form aldehyde groups through the use of oxidative enzymes. One example of an oxidative enzyme is cellulose dehydrogenase.

Once formed on the cellulose, the aldehyde group can be used for binding to particular chemical additives. The aldehyde group is a common carbonyl group that is rather reactive and used for many chemical syntheses. The aldehydes can react with various forms of nitrogen (amines, cyanohydrins, amides, etc.) to form carbon-nitrogen bonds that are stable even in the presence of water. Amines, because of their non-bonding pair of electrons, are quite nucleophilic. Aldehydes and amines will react rapidly with each other even in aqueous environments. An imine, aminal, or hemi-aminal can be formed from the reaction of an aldehyde and a primary amine. Secondary amines will also react with aliphatic aldehydes but not aromatic aldehydes. This reaction is not limited to nitrogen containing compounds. Functional groups which can react with aldehydes in aqueous systems at near neutral pH to form covalent bonds include primary amines ($—NH_2$), secondary amines ($—NHR_2$), thiols (—SH), amides ($—CONH_2$), sulfonamides ($—OSO_2NH_2$), and sulfinic acids ($—SO_2OH$). When cellulose has been modified to include aldehyde groups, the chemical additive can include any of the above groups. Alternatively, the chemical additive can include aldehyde groups and the cellulose can be modified to include any of the above functional groups.

Amines are particularly attractive for reaction with aldehydes due to their ease of preparation and ready availability. As discussed above, aldehydes and amines will react readily with each other, even in aqueous environments. An imine, aminal, or hemi-aminal can be formed from the reaction of an aldehyde and a primary amine (See FIG. 1). Secondary amines will also react with aliphatic aldehydes but not aromatic aldehydes. Secondary amines can not form imines with aldehydes but can form enamines.

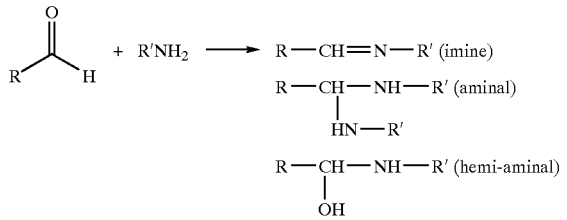

Although both the hydroxyl functional groups and the amine functional groups react with aldehydes, the amine functional groups are more nucleophillic in character. Therefore the amine functional groups will react faster and preferentially to the hydroxyl functional groups on the cellulose fiber and the process water. This affinity exhibited by the amine functional groups can be utilized in the reaction between a modified cellulose and a chemical additive containing amine groups.

In additional to aldehyde, cellulose may be modified to include other moieties in accordance with the present invention. For example, in one embodiment of the present invention, cellulose is modified to create epoxy groups on the surface of the cellulose. Epoxy groups can be formed on cellulose, for instance, through etherification by epoxidation in a solvent, such as DMAC. Ether bonds may also be formed by cross linking cellulose with epichlorohydrine. The formation of such epoxy groups, for instance, in the above described processes are disclosed in *Comprehensive Cellulose Chemistry,* Vol. 2, by Klemm, et al. (1998), which is incorporated herein by reference. In some applications, epoxy groups can also be formed on cellulose through oxidation.

In another embodiment of the present invention, cellulose is modified to form anhydride groups. Anhydride groups typically result from the reaction of an organic acid with an acid chloride with pyridine (a strong base) as a catalyst. Anhydride groups may be formed on cellulose, for instance, after the cellulose has been oxidized to form acid groups.

As described above, cellulose may be modified to include aldehyde groups, epoxy groups, and anhydride groups, which represents one subset of moieties in accordance with the present invention. It should be understood, however, that instead of one of the above groups, one of the following groups can also be chemically attached to cellulose for use in the present invention: an amine group, a thiol group, an amide group, a sulfonamide group, or a sulfinic acid group. For instance, when an amine group, a thiol group, an amide group, a sulfonamide group, or a sulfinic acid group is attached to cellulose, a chemical additive can be selected that includes aldehyde, carboxylate, epoxy, or anhydride moieties for reaction with the cellulose.

For example, modified cellulose containing amine groups are known in the art. In one embodiment for instance, cellulose may be reacted with urea according to a carbamate method as described in Klemm et al. as referenced above. Specifically, urea is reacted with cellulose with a low degree of substitution to form cellulose carbamates, which may also be considered aminated cellulose.

Chemical Additives for Reacting with the Modified Cellulose

A broad range of chemical additives may be applied to the modified fibers of the present invention. In general, the degree to which the additives may crosslink with the cellulose matrix is controlled to the point such that the fibers are repulpable by any of the standard methods known in the art. In a specific embodiment, the chemical additives that may be used in accordance with the present invention may be grouped into two basic categories: (1) softeners such as polysiloxanes; and (2) humectants which include amphiphilic hydrocarbons such as polyhydroxy and polyether derivatives.

Softeners

Softeners that may be used in accordance with the present invention include various polysiloxanes such as functionalized polysiloxanes. Functionalized polysiloxanes and their aqueous emulsions are well known commercially available materials. The ideal polysiloxane material would be of the following type structure:

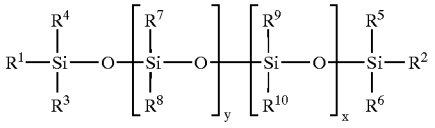

Wherein, x and y are integers >0. One or both of $R^1$ and $R^2$ is a functional group capable of reacting with the aldehyde functionality in an aqueous environment. Suitable $R^1$ and $R^2$ groups include but are not limited to primary amines —$NH_2$ and secondary amines —NH—, amides —$CONH_2$, thiols —SH, sulfinic acids —$SO_2OH$, and sulfonamides —$SO_2NH_2$ The $R^3$ to $R^{10}$ moieties can be independently any organofunctional group including $C_1$ or higher alkyl groups, ethers, polyethers, polyesters, amines, imines, amides, or other functional groups including the alkyl and alkenyl analogues of such groups and including blends of such groups. A particularly useful moiety is a polyether functional group having the generic formula: —$R^{12}$—$(R^{13}$—$O)_a$—$(R^{14}O)_b$—$R^{15}$, wherein $R^{12}$, $R^{13}$, and $R^{14}$ are independently $C_{1-4}$alkyl groups, linear or branched; $R^{15}$ can be H or a $C_{1-30}$ alkyl group; and, "a" and "b" are integers of from about 1 to about 100, more specifically from about 5 to about 30.

Other functional polysiloxanes, most notably amine and thiol derivatives, having the following structure are also well suited for the purposes of the present invention and are well known in the art and readily available:

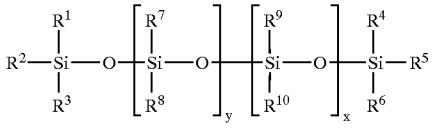

Wherein, x and y are integers >0. The mole ratio of x to (x+y) can be from about 0.005 percent to about 25 percent. The $R^1$–$R^9$ moieties can be independently any organofunctional group including $C_1$ or higher alkyl groups, ethers, polyethers, polyesters, amines, imines, amides, or other functional groups including the alkyl and alkenyl analogues of such groups. A particularly useful moiety is a polyether functional group having the generic formula: —$R^{12}$—$(R^{13}$—$O)_a$—$(R^{14}O)_b$—$R^{15}$, wherein $R^{12}$, $R^{13}$, and $R^{14}$ are independently $C_{1-4}$ alkyl groups, linear or branched; $R^{15}$ can be H or a $C_{1-30}$ alkyl group; and, "a" and "b" are integers of from about 1 to about 100, more specifically from about 5 to about 30. The $R^{10}$ moiety can include any group capable of reacting with, for instance, aldehyde groups in an aqueous environment to form covalent bonds. The preferred groups include but are not limited to primary amine, secondary amine, thiol, and unsubstituted amides. In a specific embodiment the chemical additive is an amine functional polysiloxane wherein the $R^{10}$ group contains a primary amine, secondary amine or mixture thereof.

The silicone polymers will normally be delivered as aqueous dispersions or emulsions, including microemulsions, stabilized by suitable surfactant systems that may confer a charge to the emulsion micelles. Nonionic, cationic, and anionic systems may be employed as long as the charge of the surfactant used to stabilize the emulsion does not prevent bonding to modified cellulose fibers. In other embodiments the polysiloxane may be applied to the fibers as a neat fluid.

Humectants

Plasticization in cellulose structures primarily through use of humectants including the polyethylene oxide and polypropylene oxide polymers as well as their lower molecular weight homologues such as propylene glycol, glycerin, glycerol, and polyethylene glycols of low molecular weights has been described in the literature. The majority of these materials are either low molecular weight polyhydroxy compounds or polyethers and derivatives. They are nonionic, and have no charge. The hydrophilic end often contains a polyether (polyoxyethylene) or one or more hydroxyl groups. They generally include alcohols, alkylphenols, esters, ethers, amine oxides, alkylamines, alkylamides, and polyalkylene oxide block copolymers. It has also been reported that incorporation of such materials with debonding agents can have a synergistic effect on overall product softness in tissue as well as enhanced absorbency. While such materials have been used to enhance softness in tissue products, the materials are introduced to the tissue products by spraying or coating the tissue sheet and problems have been experience with retention of the additive.

The applications of such treatments include coating a tissue sheet with a carboxylic acid derivative and a water-soluble humectant polyether blend to create a virucidal tissue product. It is also known to spray or coat the sheet with non-cationic low molecular weight polyethers and glycols, to increase softness in combination with another "binder" to counteract the decreased strength of the treated tissue product. It is also known to apply a polyhydroxy compound and an oil to a tissue sheet just after the tissue sheet has been dried on a Yankee or drum dryer but before the creping step is completed to increase the softness of the tissue sheet. A starch or synthetic resin may also be applied as to increase strength to the treated tissue sheet.

The addition of humectant polyether or glycol additives in the wet-end has been limited to use of these materials as co-solvents for various cationic softening compositions. These materials aid in the deposition of the softening agent on the cellulose fibers but do not play a direct role in affecting the properties of the tissue sheet. The absence of charge on these additives prevents the additives from binding or otherwise bonding to the cellulose fibers. In fact, it is well known that the addition of such additives in the wet-end of the paper or tissue making process is discouraged because of the resulting low retention, and therefore poor softening benefits, of these additives.

Through the process of the present invention, however, humectants can be applied to cellulosic materials forming a bond between the humectant and the cellulose. Thus, the humectant can be added during the wet end of a papermaking process without having the retention problems experienced in the past. Other advantages to using humectants in the present invention are also possible.

For instance, by reacting with the modified cellulose, it is believed that the humectants will preferentially be retained on the surface of the cellulose resulting in less diffusion of the humectant into the bulk of the cellulose, such as the bulk of a fiber. In this manner, less humectant maybe needed for a particular application. Further, it is believed that this result may be achieved with other chemical additives as well.

A second advantage is that it is believed that the humectants will be bonded to the surface of the cellulose in a configuration that optimizes mobility and reorientation capacity. In this manner, the use of the humectant will be optimized. In fact, in some applications, it is believed that the softness properties of the substrate will be improved.

Low molecular weight polyhydroxy compounds containing functional groups capable of reacting with aldehydes, carboxylates, epoxies and anhydride groups are well known commercially available materials. Examples of suitable materials include amine functional polyhydroxy compounds, amine functional polyhydric alkyl hydrocarbons, amine functional polyethers, and amine functional polyols. Specific examples include but are not limited to 2-(2-aminoethoxy)ethanol, 3-amino-1,2-propanediol, tris (hydroxymethyl) aminomethane, diethanol amine, 1-amino-1-deoxy-D-sorbitol (glucamine), 2-aminoethyl hydrogen sulfate, 2-amino-2-ethyl-1,3-propanediol, 2-(2-aminoethoxy) ethanol, o-(2-aminopropyl)-o'-(2-methoxyethyl) propylene glycol, 2-aminoethanol, 1-amino-2-propanol, 2-amino-1 phenyl-1,3-propanediol, 2-amino-1,3-propanediol, 3-amino-1-propanol, ethanolamine, 3-amino-2-hydroxy propionic acid, 1-amino-2,3,4-trihydroxybutane, 4-amino-2-hydroxybutyric acid, aspartic acid, 2-amino-2-methyl-1,3-propanediol, and 2-amino-1,3-propanediol. Low molecular weight thiols include as examples 3-mercapto-1,2-propanediol, 2-mercaptoethanol, 2-(methylamino ethanol), and mercaptosuccinic acid.

Especially suited to the present invention are the amino and mercapto functional polyethers. Amino functional polyethers, often referred to as polyalkyleneoxy amines, are well known compositions that may be prepared by the reductive amination of polyalkyleneoxy alcohols using hydrogen and ammonia in the presence of a catalyst. This reductive amination of polyols is described in U.S. Pat. Nos. 3,128,311; 3,152,998; 3,236,895; 3,347,926; 3,654,370; 4,014,933; 4,153,581; and, 4,766,245. The molecular weight of the polyalkyleneoxy amine material, when employed is preferably in the range of from about 100 to about 4,000. Additional examples of amine containing polymers having carbon-oxygen backbone linkages and their uses are described in U.S. Pat. Nos. 3,436,359; 3,155,728; and, 4,521,490. Examples of suitable commercially available polyalkyleneoxy amines are materials sold under the trade name Jeffamine® manufactured by Huntsman Chemical Corporation.

Jeffamine® polyalkyleneoxy amines may, in one embodiment, have the following formula:

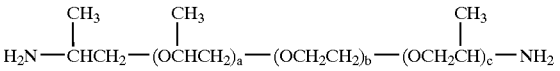

wherein a+c is 0 to 5 and b is 0 to 50.

For example, the following are particular Jeffamine® products commercially available:

| Product Designation | a, b and c |
|---|---|
| D-230 | a + b = 2.5; b = 0 |
| D-400 | a + b = 5.0; b = 0 |
| ED600 | a + b = 2.5; b = 5.5 |
| ED900 | a + b = 2.5; b = 8.5 |
| ED2003 | a + b = 5.0; b = 39.5 |
| EDR148 | a + b = 0.0; b = 2.0 |

In another embodiment of the present invention, the humectant comprises bis (3-amino propyl) terminated polytetrahydrofuran.

Additional derivatives of the polyethers are known including the thiols. They can be obtained via different means including reaction of the corresponding polyoxyalkylene glycol with thionyl chloride to give the corresponding chloro derivative, followed by reaction with thiourea and hydrolysis of the product to give the desired thiol derivative. Examples of the synthesis of thiol derivatives via this process can be found in U.S. Pat. No. 5,143,999. Reactions of alcohols to give thiols is described in a variety of texts such as *Organic Synthesis,* Collective Volume 4, pp. 401–403, 1963. Dithiols and mono thiols can be obtained via the reaction depending on the nature of the starting polyether. As with the diamines, the starting polyoxyalkylene derivatives can be a polyethylene, polypropylene, polybutylene, or other appropriate polyether derivative as well as copolymers having mixtures of the various polyether components. Such copolymers can be block or random.

Liquid polysulfide polymers of the general formula:

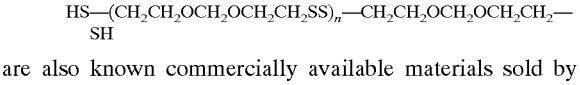

are also known commercially available materials sold by Morton International under the trade name THIOKOL® which have been used in combination with amine curing agents in epoxide resins. These polymeric materials would be expected to react in a like manner with the aldehyde functionality to be incorporated into the polymer backbone.

Process for Combining the Modified Cellulose with the Chemical Additive

Once cellulose has been modified to include a first moiety and a chemical additive chosen that contains a second moiety in accordance with the present invention, the modified cellulose and the chemical additive can be combined for reaction under many different conditions and at many different points in the process of making the cellulose article. For many embodiments, for instance, the first moiety will react with the second moiety within a pH range from about 2 to about 11. Acidic conditions, in fact, may catalyze the reaction. For instance, low pH conditions are conducive to reacting aldehydes with amines.

Similar to the above described pH range, the temperature range under which the first moiety may react with the second moiety also varies widely. For example, in many applications, the first moiety will react with the second moiety at room temperature. Higher temperatures may increase the reaction rate.

In forming articles and products made in accordance with the present invention, the modified cellulose and chemical additive can be contacted and reacted together at various stages in the production process. For example, in one embodiment, the modified cellulose can be combined and reacted with the chemical additive prior to formation of the article. For example, when forming paper products, the modified cellulose and chemical additive can both be added to the wet end of the papermaking process when the fibers reside in a slurry of water at a consistency of from about 0.5% to about 20%. Since the chemical additive is bonded to the modified cellulose, most if not all of the chemical additive will be retained on the cellulose during formation of the nonwoven web. This aspect of the present invention provides many benefits and advantages, especially when incorporating into a web a softener or a humectant. As described above, many of these types of materials were not capable of being added into the wet end of a papermaking process without having significant retention problems. Through the chemical linkage that is formed between the additive and the modified cellulose, however, many of the problems experienced in the prior art are overcome.

In another embodiment the modified fibers and chemical additive are mixed in the pulp plant while the fibers exist as a slurry in water prior to forming the pulp sheet. The pulp slurry is then deposited onto a wire and dewatered to form a wet fibrous web comprising the chemical additive bonded to the cellulose fibers. The wet fibrous web may then be dried to a predetermined consistency thereby forming a dried fibrous web comprising the chemical additive bonded to the cellulose fibers. The dried fibrous web can then be redispersed in water at a separate production facility, such as a tissue machine to be used to form a paper tissue product in accordance with the present invention When forming tissue webs, it should also be understood that the web may be formed from modified cellulose in conjunction with other fibers. In this regard, nonwoven webs made in accordance with the present invention need only contain modified cellulose in an amount sufficient for the web to retain a desired amount of the chemical additive. The remainder of the web can be made from other pulp fibers, such as nonmodified pulp fibers. Such pulp fibers can include, for instance, virgin fibers and recycled fibers. Such fibers can include northern softwood kraft and hardwood fibers.

In one particular embodiment of the present invention, the method of combining the modified pulp fibers with the chemical additive can include first combining process water with modified pulp fibers and, if desired, other types of fibers. The fiber slurry may be transported to a web-forming apparatus of a pulp sheet machine and formed into a wet fibrous web. The wet fibrous web may be dried to a predetermined consistency thereby forming a dried or partially dried fibrous web. The dried or partially dried fibrous web may then be treated with the chemical additive causing the additive to bond to the modified fibers. The treated web is then redispersed in water and can later be used to form a paper product in accordance with the present invention. In this embodiment it is important that the modified fibers do not react with each other to a great extent prior to addition of the chemical additive. Such reaction can cause the fibers to be non-repulpable and also diminishes the effectiveness of the cellulose to retain the chemical additive.

In addition to being able to apply the chemical additive in the wet end of a papermaking process, the chemical additive can also be applied topically to the article being formed. In this embodiment, the article can be made with modified cellulose. The chemical additive can then be applied to the surface of the article causing the chemical additive to form a chemical linkage with the modified cellulose. In general, the chemical additive can be applied to the article when the article is either dry or wet.

When applied topically, various methods can be used to apply the additive to the surface of the article. For example, the chemical additive can be sprayed onto the article, printed onto the article, coated onto the article, extruded onto the article, and the like.

In another embodiment of the present invention, an article can be formed containing cellulose and, after the article is formed, the cellulose can be modified to include a first moiety and then contacted with a chemical additive containing a second moiety that forms a chemical linkage with the first moiety. For example, this embodiment, a paper web may be formed containing cellulose fibers. A surface treatment may then be used to modify at least a portion of the cellulose fibers contained within the paper web. For example, in one embodiment, the paper web can be subjected to a corona treatment which oxidizes the cellulose and forms, for instance, aldehyde groups on the cellulose. After the cellulose is modified, a chemical additive can then be applied topically which reacts with the modified cellulose.

The amount of the chemical additive, whether it be a softener or a humectant, that can be incorporated into the final product is not overly critical to the present invention and is limited only by the equivalence of the first moiety present on the modified cellulose and the second moiety present on the chemical additive. In general, from about 2% to about 100% of the available moiety groups on the modified cellulose may be reacted with the chemical additive, more specifically from about 5% to about 100%, and still more specifically from about 10% to about 100%. In some cases, it may be advantageous to react only a portion of the moiety groups on the modified cellulose to the chemical additive. For instance, the first moiety on the modified cellulose may be reacted with a second chemical additive or other ingredients or may provide benefits to the final product if left unreacted.

Various different types of products and articles may be made in accordance with the present invention containing the modified cellulose in conjunction with the chemical additive. For example, in one embodiment, the present invention is directed to the formation of tissue products, such as facial tissue, bath tissue, and paper towels. The tissue products can have a basis weight, for instance, from about 6 gsm to about 200 gsm and greater. For example, in one embodiment, the tissue product can have a basis weight from about 6 gsm to about 80 gsm.

Tissue products incorporated with a chemical additive in accordance with the present invention may be made by any suitable process. For the tissue sheets of the present invention, both creped and uncreped methods of manufacture may be used. Uncreped tissue production is disclosed in U.S. Pat. No. 5,772,845, issued on Jun. 30, 1998 to Farrington, Jr. et al., the disclosure of which is herein incorporated by reference to the extent it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all of which are herein incorporated by reference to the extent that they are non-contradictory herewith. Also suitable for application of the above mentioned chemical additives are tissue sheets that are pattern densified or imprinted, such as the webs disclosed in any of the following U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of all of which are herein incorporated by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits is deflected by an air pressure differential across the deflection conduit to form a lower-density pillow-like region or dome in the tissue sheet.

Various drying operations may be useful in the manufacture of the tissue products of the present invention. Examples of such drying methods include, but are not limited to, drum drying, through drying, steam drying such as superheated steam drying, displacement dewatering, Yankee drying, infrared drying, microwave drying, radio frequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27,1993 to I. A. Andersson et al.

The tissue product may contain a variety of fiber types, in addition to the modified cellulose, both natural and synthetic. In one embodiment the tissue product comprises hardwood and softwood fibers. The overall ratio of hardwood pulp fibers to softwood pulp fibers within the tissue product, including individual tissue sheets making up the product may vary broadly. The ratio of hardwood pulp fibers to softwood pulp fibers may range from about 9:1 to about 1:9, more specifically from about 9:1 to about 1:4, and most specifically from about 9:1 to about 1:1. In one embodiment of the present invention, the hardwood pulp fibers and softwood pulp fibers may be blended prior to forming the tissue sheet thereby producing a homogenous distribution of hardwood pulp fibers and softwood pulp fibers in the z-direction of the tissue sheet. In another embodiment of the present invention, the hardwood pulp fibers and softwood pulp fibers may be layered so as to give a heterogeneous distribution of hardwood pulp fibers and softwood pulp fibers in the z-direction of the tissue sheet. In another embodiment, the hardwood pulp fibers may be located in at least one of the outer layers of the tissue product and/or tissue sheets wherein at least one of the inner layers may comprise softwood pulp fibers. In still another embodiment the tissue product contains secondary or recycled fibers optionally containing virgin or synthetic fibers.

In addition, synthetic fibers may also be utilized in the present invention. The discussion herein regarding pulp fibers is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly(lactic acid) (PLA), poly(β-malic acid) (PMLA), poly(ε-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in one or all of the layers and sheets comprising the tissue product.

When forming paper webs in accordance with the present invention, other various chemical additives may be incorporated into the web.

Optional Chemical Additives

Optional chemical additives may also be added to the aqueous papermaking furnish or to the embryonic tissue sheet to impart additional benefits to the product and process and are not antagonistic to the intended benefits of the present invention. The following materials are included as examples of additional chemicals that may be applied to the tissue sheet. The chemicals are included as examples and are not intended to limit the scope of the present invention. Such chemicals may be added at any point in the papermaking process, such as before or after addition of the chemical additive. They may also be added simultaneously with the chemical additive. They may be blended with the chemical additive of the present invention or as separate additives.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Strength Agents

Wet and dry strength agents may also be applied to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemcial Company and other aldehyde containing polymers such as those described in U.S. Pat. No. 6,224,714 issued on May 1, 2001 to Schroeder et al.; U.S. Pat. No. 6,274,667 issued on Aug. 14, 2001 to Shannon et al.; U.S. Pat. No. 6,287,418 issued on Sep. 11, 2001 to Schroeder et al.; and, U.S. Pat. No. 6,365,667 issued on Apr. 2, 2002 to Shannon et al., the disclosures of which are herein incorporated by reference to the extend they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. : 3,700,623 issued on Oct. 24,1972 to Keim; U.S. Pat. No. 3,772,076 issued on Nov. 13, 1973 to Keim; U.S. Pat. No. 3,855,158 issued on Dec. 17, 1974 to Petrovich et al.; U.S. Pat. No. 3,899,388 issued on Aug. 12, 1975 to Petrovich et al.; U.S. Pat. No. 4,129,528 issued on Dec. 12, 1978 to Petrovich et al.; U.S. Pat. No. 4,147,586 issued on Apr. 3, 1979 to Petrovich et al.; and, U.S. Pat. No. 4,222,921 issued on Sep. 16, 1980 to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the cationic synthetic co-polymers of the present invention and apply the two chemicals simultaneously to the tissue sheet.

Additional Softening Agents

At times it may be advantageous to add additional debonders or softening chemistries to a tissue sheet. Examples of such debonders and softening chemistries are broadly taught in the art. Exemplary compounds include the simple quaternary ammonium salts having the general formula $(R^{1'})_{4-b}N^{+}(R^{1''})_{b}X^{-}$ wherein R1' is a C1–6 alkyl group, R1" is a C14–C22 alkyl group, b is an integer from 1 to 3 and X— is any suitable counterion. Other similar compounds include the monoester, diester, monoamide and diamide derivatives of the simple quaternary ammonium salts. A number of variations on these quaternary ammonium compounds are known and should be considered to fall within the scope of the present invention. Additional softening compositions include cationic oleyl imidazoline materials such as methyl-1-oleyl amidoethyl-2-oleyl imidazolinium methylsulfate commercially available as Mackernium DC-183 from McIntyre Ltd., located in University Park, Ill. and Prosoft TQ-1003 available from Hercules, Inc.

Miscellaneous Agents

In general, the present invention may be used in conjunction with any known materials and chemicals that are not antagonistic to its intended use. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, absorbency aids and the like. A wide variety of other materials and chemicals known in the art of papermaking and tissue production may be included in the tissue sheets of the present invention including lotions and other materials providing skin health benefits including but not limited to such things as aloe extract and tocopherols such as Vitamin E and the like.

The application point for such materials and chemicals is not particularly relevant to the present invention and such materials and chemicals may be applied at any point in the tissue manufacturing process. This includes pre-treatment of pulp, co-application in the wet end of the process, post treatment after drying but on the tissue machine and topical post treatment.

In addition to tissue products, personal care articles can also be formed in accordance with the present invention. In general, any suitable personal care article that incorporates cellulosic materials may be treated with the chemical additive of the present invention as described above. Examples of personal care articles include, for instance, diapers, feminine hygiene products, and the like.

The present invention may be better understood with respect to the following examples.

To demonstrate the use of aldehyde cellulose to improve the retention of humectants and softeners on cellulose fibers through chemical linkage the following examples have been included.

1. 3-amino-1,2 propane diol
2. Jeffamine M-2070
3. Jeffamine ED-600
4. Diethanol amine
5. Tris(hydroxymethyl)amino methane
6. 2-(2-aminothoxy)ethanol
7. Jeffamine M-600
8. Jeffamine M-1000

Retention of the amine on the modified cellulose was observed.

EXAMPLE 2

In this example, aldehyde cellulose, having a copper number of 7.25, was prepared by periodate oxidation method as described above. Next, five-gram samples of the aldehyde cellulose were reacted with various amines at multiple reaction temperature and times. Also, Jeffamine ED-900 was added to a sample at a 1 to 4 molar ratio of amine to aldehyde and tested. Further, diamines were tested.

Then, about 1/10 of the fibers were diluted with 500 cc of deionized (DI) water and vacuum filtered on a glass frit Bucchner funnel. The filter sheets were removed from the funnel and placed in a 125° C. oven to dry for 5 minutes. After the samples were washed and dried, they were sent to a commercial laboratory for elemental Nitrogen analysis. The results are shown in the following table:

| Amine Added To Aldehyde Cellulose | Reaction Time | Temp | % $N_2$ Found | % By Weight | # Per Ton | % Substitution |
|---|---|---|---|---|---|---|
| Jeffamine ED-900 | 120 min | 50° C. | 0.32 | 10.9 | 206 | 30.1 |
| 2-(2-aminoethoxy) ethanol | | | 0.22 | 1.65 | 33 | 15.3 |
| Diethanol amine | 120 min | 50° C. | 0.21 | 1.58 | 32 | 14.6 |
| o-(2-aminopropyl)-o'-(2-methoxyethyl) polypropylene glycol | | | 0.21 | 9.00 | 180 | 22.0 |
| 3-amino-1,2propanediol | 30 min | R.T. | 0.83 | 5.40 | 108 | 57.0 |
| 3-amino-1,2propanediol | 16 hrs | R.T. | 0.47 | 3.06 | 61 | 32.3 |
| Tris(hydroxymethyl)aminomethane | | | 0.56 | 4.85 | 97 | 39.6 |
| Jeffamine M-1000 | | | 0.21 | 15.00 | 300 | 28.0 |
| Jeffamine M-2070 | 30 min | R.T. | 0.19 | 28.09 | 562 | 39.9 |
| Jeffamine M-2070 | 16 hrs | R.T. | 0.16 | 23.67 | 473 | 33.6 |

The control sample had a nitrogen content below the lower detection limit of the test (<0.1% $N_2$). Typically cellulose has a $N_2$ content of <30 ppm.

EXAMPLE 1

In this particular example, dialdehyde cellulose was prepared by treating cellulose with periodate as known in the art. The pulp was oxidized by the periodate treatment, and reactive aldehyde groups developed on the surface. Next, the polysaccharide was made into a slurry with a consistency of about 2–3%. Then, an amine, such as an aminated polypropylene glycol, like Jeffamines® produced by Huntsman Chemical Inc, was added to the slurry in approximately a 2 to 8 fold molar excess of amine to aldehyde to convert as many aldehyde groups as possible.

The slurry was given the appropriate time, depending on the amine used and the experimental conditions, anywhere from about 30 minutes to about 12 hours, to react. Finally, the reacted slurry was washed in water and filtered several times to remove residual unreacted amine.

The following amines were reacted with aldehyde cellulose:

As shown in the table below, the monoamine codes all showed increased dispersibility indicating reaction of the aldehyde group with amine. Additionally, the results show shorter reaction times and cooler temperatures appear to favor the reactions. Further, the results demonstrate highly hindered amines tris(hydroxymethyl)amino methane and secondary amines (diethanol amine)are also easily incorporated into the cellulose.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An article of manufacture comprising:

a substrate containing cellulose, at least a portion of the cellulose having been modified to form a first moiety, the first moiety being present at the surface of the cellulose;

a chemical additive comprising a softener or a humectant, the chemical additive containing a second moiety that has formed a chemical linkage with the first moiety;

wherein the first moiety comprises an aldehyde, an epoxy or an anhydride group and the second moiety comprises an amine, a thiol, an amide, a sulfonamide, or a sulfinic acid group; or the first moiety comprises an amine, a thiol, an amide, a sulfonamide or a sulfinic acid group and the second moiety comprises an aldehyde, a carboxylate, an epoxy, or an anhydride group.

2. An article as defined in claim 1, wherein the first moiety comprises an aldehyde, an epoxy, or an anhydride group.

3. An article as defined in claim 2, wherein the first moiety comprises an aldehyde group.

4. An article as defined in claim 2, wherein the second moiety comprises a primary, secondary or mixture of primary and secondary amine groups.

5. An article as defined in claim 3, wherein the second moiety comprises a primary, secondary or mixture of primary and secondary amine groups.

6. An article as defined in claim 1, wherein the modified cellulose forms a covalent bond with the chemical additive.

7. An article as defined in claim 1, wherein the cellulose contained in the substrate comprises modified cellulose fibers containing the first moiety.

8. An article as defined in claim 7, wherein the modified cellulose fibers are combined with non-modified cellulose fibers.

9. An article as defined in claim 1, wherein the modified cellulose comprises oxidized cellulose.

10. An article as defined in claim 1, wherein the first moiety comprises an amine group.

11. An article as defined in claim 10, wherein the second moiety comprises an aldehyde group.

12. An article as defined in claim 1, wherein the chemical additive comprises an amine functional polyether, an amine functional polyol, or an amine functional polyhydroxy compound.

13. An article as defined in claim 1, wherein the chemical additive comprises a polysiloxane having the following structure:

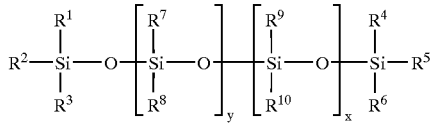

wherein:

x, y=integers>0 such that the mole ratio of x to (x+y) is from about 0.001 percent to about 25 percent;

$R^1$, $R^2$, $R^3$, $R^4$, $R^5$, $R^6$, $R^7$, $R^8$, and $R^9$ moieties are independently any organofunctional group including $C_1$ to $C_{30}$ alkyl groups, ethers, polyethers, polyesters, amines, imines, amides, or other functional groups including the alkyl and alkenyl analogues of such groups; and wherein at least one of $R^2$, $R^5$, and $R^{10}$ comprises the second moiety.

14. An article as defined in claim 13, wherein the chemical additive is an amino functional polysiloxane.

15. The article as defined in claim 13 wherein the first moiety comprises an aldehyde.

16. An article as defined in claim 1, wherein the chemical additive is selected from the group consisting of: 1-amino-2-propanol; 2-amino-1-propanol; 3-amino-1,2-propanediol; tris(hydroxymethyl) aminomethane; diethanol amine; 2-(2-aminoethoxy) ethanol; o-(2-aminopropyl)-o'-(2-methoxyethyl) propylene glycol; 2-amino ethanol; glucamine; N-methyl glucamine; 2-amino-2-ethyl-1,3-propanediol; 2-amino-1,3-propanediol; 3-amino-1-propanol; ethanolamine; 1-amino-2,3,4-trihydroxybutane; 4-amino-2-hydroxybutyric acid; 2-amino-2-methyl-1,3-propanediol; 2-amino-1,3-propanediol; 3-mercapto-1,2-propanediol; 2-mercaptoethanal; 2-(methylamine ethanol) and, mixtures thereof.

17. An article as defined in claim 1, wherein the chemical additive comprises an amino functional polyether.

18. An article as defined in claim 17, wherein the chemical additive comprises:

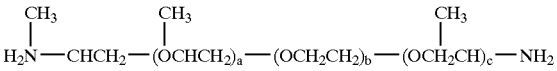

wherein a+c is 0 to 5 and b is 0 to 50.

19. An article as defined in claim 1, wherein the chemical additive comprises bis(3-aminopropyl) terminated polytetrahydrofuran.

20. An article as defined in claim 1, wherein the chemical additive comprises an amino functional polysiloxane.

21. An article as defined in claim 1, wherein the article comprises a tissue product having a bulk of greater than about 2 $cm^3/g$.

22. An article as defined in claim 21, wherein the article comprises a facial tissue.

23. An article as defined in claim 1, wherein the article comprises a personal care article.

24. An article as defined in claim 1, wherein the article comprises a wet wipe.

25. An article as defined in claim 7, wherein the substrate comprises a non-woven web.

26. An article as defined in claim 1, wherein the chemical additive is selected from the group consisting of: polyalkyleneoxy amine; diamine; thiol; and, dithiol, and having the following structure:

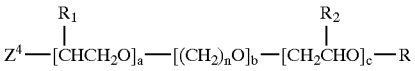

wherein:

$Z^4$=a non-hydroxyl aldehyde reactive functionality selected from the group consisting of:

primary amine; secondary amine; thiol; or, unsubstituted amide;

$R_1$ and $R_2$ are independently H or $CH_3$;

a, b, c=integers greater≧0 such that a+b+c≧2;

n=an integer≧2 and ≦6; and,

R=H; $C_1$–$C_{30}$ linear or branched, substituted or non-substituted, aliphatic or aromatic, saturated or unsaturated hydrocarbon; —$[CH_2CHCH_3]$-$Z^4$; or, —$[(CH_2)_n]$-$Z^4$.

27. An article as defined in claim 26 wherein the second moiety comprises an aldehyde group.

28. A tissue product comprising:

a paper sheet containing cellulose fibers that have been modified to form a first moiety, the first moiety being present at the surface of the cellulose fibers;

a chemical additive comprising a softener or a humectant, the chemical additive containing a second moiety that has formed a chemical linkage with the first moiety;

wherein the first moiety comprises an aldehyde, an epoxy or an anhydride group and the second moiety comprises an amine, a thiol, an amide, a sulfonamide, or a sulfinic acid group; or the first moiety comprises an amine, a thiol, an amide, a sulfonamide or a sulfinic acid group and the second moiety comprises an aldehyde, a carboxylate, an epoxy, or an anhydride group.

29. A tissue product as defined in claim 28, wherein the first moiety comprises an aldehyde, an epoxy, or an anhydride group.

30. A tissue product as defined in claim 29, wherein the first moiety comprises an aldehyde group.

31. A tissue product as defined in claim 30, wherein the second moiety comprises a primary, secondary or mixture of primary and secondary amine groups.

32. A tissue product as defined in claim 28, wherein the modified cellulose forms a covalent bond with the chemical additive.

33. A tissue product as defined in claim 28, wherein the paper sheet further contains non-modified cellulose fibers.

34. A tissue product as defined in claim 28, wherein the modified cellulose fibers have been oxidized.

35. A tissue product as defined in claim 28, wherein the first moiety comprises a primary, secondary or mixture of primary and secondary amine groups.

36. A tissue product as defined in claim 35, wherein the second moiety comprises an aldehyde group.

37. A tissue product as defined in claim 35, wherein the second moiety comprises a carboxylate group.

38. A tissue product as defined in claim 28, wherein the chemical additive comprises an amine functional polyether, an amine functional polyol, or an amine functional polyhydroxy compound.

39. A tissue product as defined in claim 28, wherein the chemical additive comprises a polysiloxane having the following structure:

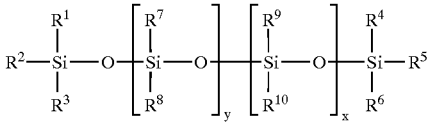

wherein:

x, y=integers>0 such that the mole ratio of x to (x+y) is from about 0.001 percent to about 25 percent;

$R^1$, $R^2$, $R^3$, $R^4$, $R^5$, $R^6$, $R^7$, $R^8$, and $R^9$ moieties are independently any organofunctional group including $C_1$ to $C_{30}$ alkyl groups, ethers, polyethers, polyesters, amines, imines, amides, or other functional groups including the alkyl and alkenyl analogues of such groups; and wherein at least one of $R^2$, $R^5$, and $R^{10}$ comprises the second moiety.

40. A tissue product as defined in claim 39, wherein the chemical additive is an amino functional polysiloxane.

41. A tissue product as defined in claim 39 wherein the first moiety comprises an aldehyde.

42. A tissue product as defined in claim 28, wherein the chemical additive is selected from the group consisting of: 1-amino-2-propanol; 2-amino-1-propanol; 3-amino-1,2-propanediol; tris(hydroxymethyl) aminomethane; diethanol amine; 2-(2-aminoethoxy) ethanol; o-(2-aminopropyl)-o'-(2-methoxyethyl) propylene glycol; 2-amino ethanol; glucamine; N-methyl glucamine; 2-amino-2-ethyl-1,3-propanediol; 2-amino-1,3-propanediol; 3-amino-1-propanol; ethanolamine; 1-amino-2,3,4-trihydroxybutane; 4-amino-2-hydroxybutyric acid; 2-amino-2-methyl-1,3-propanediol; 2-amino-1,3-propanediol; 3-mercapto-1,2-propanediol; 2-mercaptoethanal; 2-(methylamine ethanol) and, mixtures thereof.

43. A tissue product as defined in claim 42 wherein the first moiety is an aldehyde.

44. A tissue product as defined in claim 28, wherein the chemical additive comprises a polyamine functional polyether.

45. A tissue product as defined in claim 44, wherein the chemical additive comprises:

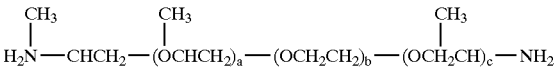

wherein a+c is 0 to 5 and b is 0 to 50.

46. A tissue product as defined in claim 28, wherein the article comprises a facial tissue.

47. A tissue product as defined in claim 28, wherein the chemical additive is selected from the group consisting of: polyalkyleneoxy amine; diamine; thiol; and, dithiol, and having the following structure:

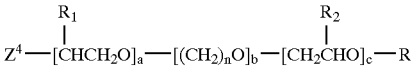

wherein:

$Z^4$=a non-hydroxyl aldehyde reactive functionality selected from the group consisting of:

primary amine; secondary amine; thiol; or, unsubstituted amide;

$R_1$ and $R_2$ are independently H or $CH_3$;

a, b, c=integers greater≧0 such that a+b+c≧2;

n=an integer≧2 and ≦6; and,

R=H; $C_1$–$C_{30}$ linear or branched, substituted or non-substituted, aliphatic or aromatic, saturated or unsaturated hydrocarbon; —$[CH_2CHCH_3]$-$Z^4$; or, —$[(CH_2)_n]$-$Z^4$.

48. A method of making a paper sheet comprising:

forming a paper web from an aqueous suspension of cellulose fibers;

modifying at least a portion of the cellulose fibers says to form a first moiety on the surface of the fibers;

contacting the modified fibers with a chemical additive, the chemical additive comprising a softener or a humectant, the chemical additive containing a second moiety that forms a chemical linkage with the first moiety;

wherein the first moiety comprises an aldehyde, an epoxy or an anhydride group and the second moiety comprises an amine, a thiol, an amide, a sulfonamide, or a sulfinic acid group; or the first moiety comprises an amine, a thiol, an amide, a sulfonamide or a sulfinic acid group and the second moiety comprises an aldehyde, a carboxylate, an epoxy, or an anhydride group.

49. A method as defined in claim 48, wherein the first moiety comprises an aldehyde, an epoxy, or an anhydride group.

50. A method as defined in claim 49, wherein the first moiety comprises an aldehyde group.

51. A method as defined in claim 50, wherein the second moiety comprises a primary, secondary or mixture of primary and secondary amine groups.

52. A method as defined in claim 48, wherein the modified cellulose forms a covalent bond with the chemical additive.

53. A method as defined in claim 48, wherein the paper web comprises modified cellulose fibers and non-modified cellulose fibers.

54. A method as defined in claim 48, wherein the first moiety comprises a primary, secondary or mixture of primary and secondary amine groups.

55. A method as defined in claim 54, wherein the second moiety comprises an aldehyde group.

56. A method as defined in claim 48, wherein the chemical additive comprises an amine functional polyether, an amine functional polyol, or an amine functional polyhydroxy compound.

57. A method as defined in claim 48, wherein the chemical additive comprises a polysiloxane having the following structure:

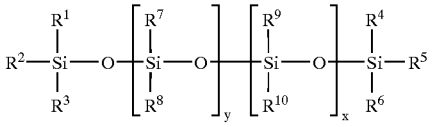

wherein:

x, y=integers>0 such that the mole ratio of x to (x+y) is from about 0.001 percent to about 25 percent;

$R^1$, $R^2$, $R^3$, $R^4$, $R^5$, $R^6$, $R^7$, $R^8$, and $R^9$ moieties are independently any organofunctional group including $C_1$ to $C_{30}$ alkyl groups, ethers, polyethers, polyesters, amines, imines, amides, or other functional groups including the alkyl and alkenyl analogues of such groups; and wherein at least one of $R^2$, $R^5$, and $R^{10}$ comprises the second moiety.

58. A method as defined in claim 57, wherein the chemical additive is an amino functional polysiloxane.

59. A method as defined in claim 57 wherein the first moiety comprises an aldehyde.

60. A method as defined in claim 48, wherein the chemical additive is selected from the group consisting of: 1-amino-2-propanol; 2-amino-1-propanol; 3-amino-1,2-propanediol; tris(hydroxymethyl) aminomethane; diethanol amine; 2-(2-aminoethoxy) ethanol; o-(2-aminopropyl)-o'-(2-methoxyethyl) propylene glycol; 2-amino ethanol; glucamine; N-methyl glucamine; 2-amino-2-ethyl-1,3-propanediol; 2-amino-1,3-propanediol; 3-amino-1-propanol; ethanolamine; 1-amino-2,3,4-trihydroxybutane; 4-amino-2-hydroxybutyric acid; 2-amino-2-methyl-1,3-propanediol; 2-amino-1,3-propanediol; 3-mercapto-1,2-propanediol; 2-mercaptoethanal; 2-(methylamine ethanol) and, mixtures thereof.

61. A method as defined in claim 48, wherein the chemical additive comprises a amino functional polyether.

62. A method as defined in claim 61, wherein the chemical additive comprises:

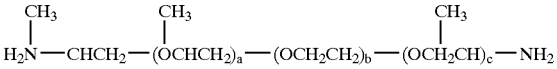

wherein a+c is 0 to 5 and b is 0 to 5.

63. A method as defined in claim 48, wherein the chemical additive is selected from the group consisting of: polyalkyleneoxy amine; diamine; thiol; and, dithiol, and having the following structure:

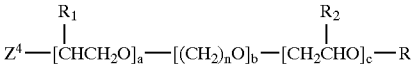

wherein:

$Z^4$=a non-hydroxyl aldehyde reactive functionality selected from the group consisting of:

primary amine; secondary amine; thiol; or, unsubstituted amide;

$R_1$ and $R_2$ are independently H or $CH_3$;

n=an integer≧2 and ≦6; and,

R═H; $C_1$–$C_{30}$ linear or branched, substituted or non-substituted, aliphatic or aromatic, saturated or unsaturated hydrocarbon; —$[CH_2CHCH_3]$-$Z^4$; or, —$[(CH_2)_n]$-$Z^4$.

64. A method as defined in claim 48, wherein the cellulose fibers are modified by oxidizing the cellulose fibers.

65. A method as defined in claim 64, wherein the cellulose fibers are oxidized using a chemical oxidizing agent.

66. A method as defined in claim 65, wherein the chemical oxidizing agent comprises: ozone, hydrogen peroxide, or a peracid.

67. A method as defined in claim 64, wherein the cellulose fibers are oxidized by exposing the fibers to radiant energy.

68. A method as defined in claim 67, wherein the cellulose fibers are oxidized by subjecting the fibers to a corona treatment.

69. A method as defined in claim 64, wherein the cellulose fibers are oxidized by contacting the fibers with an enzyme.

70. A method as defined in claim 48, wherein the cellulose fibers are modified by partially carboxymethylating the fibers.

71. A method as defined in claim 48, wherein the cellulose fibers are modified to form the first moiety prior to forming the aqueous suspension.

72. A method as defined in claim 48, wherein the cellulose fibers are modified within the aqueous suspension.

73. A method as defined in claim 48, wherein the modified cellulose fibers are contacted with the chemical additive in the aqueous suspension.

74. A method as defined in claim 48, wherein the aqueous suspension contains the modified cellulose fibers and the chemical additive is applied topically to the formed paper web.

75. A method as defined in claim 48, wherein the cellulose fibers are modified to form the first moiety after the paper web is formed, and wherein the chemical additive is topically applied to the formed paper web.

76. A method as defined in claim 75, wherein the cellulose fibers are modified by subjecting the paper web to a corona treatment.

* * * * *